United States Patent [19]

Chase et al.

[11] 4,249,333

[45] Feb. 10, 1981

[54] INFANT DEVELOPMENT RING TOY

[75] Inventors: Richard A. Chase, Baltimore, Md.; D. Michael Williams, Morin Heights, Canada; Danny E. Simpson, Baltimore, Md.

[73] Assignee: Johnson & Johnson, New Brunswick, N.J.

[21] Appl. No.: 884,780

[22] Filed: Mar. 8, 1978

[51] Int. Cl.[3] ..... A63H 33/00

[52] U.S. Cl. ..... 46/1 R; 128/359

[58] Field of Search ..... 46/1 R, 175, 175 R, 46/193; 128/359; D21/63; D24/45

[56] References Cited

U.S. PATENT DOCUMENTS

| | | | |
|---|---|---|---|
| D. 140,681 | 3/1945 | Stuart | D21/63 |
| 1,171,229 | 2/1916 | Morse | 46/193 |
| 1,185,341 | 5/1916 | Morse | 46/193 |
| 2,078,022 | 4/1937 | Roemer | 46/1 R |
| 2,112,316 | 3/1938 | Turner | 128/359 X |
| 2,738,616 | 3/1956 | Windle | 46/1 R |
| 2,827,055 | 3/1958 | Carden | 128/359 |
| 3,283,758 | 11/1966 | Killebrew | 128/359 |
| 3,633,587 | 1/1972 | Hunt | 128/359 |
| 3,690,324 | 9/1972 | Spivack | 128/359 |

OTHER PUBLICATIONS

Creative Playthings Catalog 1969–1970, received in the PTO 11-14-69, p. 5.

*Primary Examiner*—F. Barry Shay

[57] ABSTRACT

An infant development toy comprising a plurality of rings of varying diameter connected to each other and to a central object by a flexible connecting means. Optionally, the connecting means may be extended outside the rings to form a primary handle, and a bell may be contained within the central object or the primary handle. The rings and central object are of a size, and are spaced along the connecting means in such a manner that, when the toy is held aloft by and suspended from the point of connection of the largest ring and the connecting means, the rings are concentric and surround the central object.

5 Claims, 3 Drawing Figures

INFANT DEVELOPMENT RING TOY

BACKGROUND OF THE INVENTION

The present invention relates to infant playthings, and more specifically to playthings co-ordinated with the stages of learning and development in the first years of life. The toy of the present invention is designed to invite interaction and provide a stimulating response to such interaction. The toy invites and responds to the predictable patterns of hand movement and manipulative activities learned and practised in the first year and a half of life.

Within about the first week of life, a child exhibits a reflex grasping action with which he will attempt to wrap his fingers around and grasp anything placed in contact with his palm. As this grasping technique is developed it becomes accompanied by arm movements, the first of which take the form of random movements in a predictable arc over the body while the child is laying on his back. At a very early age, the child will attempt to grasp objects encountered in this random arm movement.

For many years, infant developmental testing kits and specifically the Gesell Kit have included a wooden ring approximately six inches in diameter that was painted or stained red. The ring was used to test eye tracking and reflex arm movement and grasping. This testing was accomplished by suspending the ring on a string, and moving it slowly back and forth above the face of a reclining child. The ring was developed from an embroidery hoop which had proven a successful grasping object for young babies. The ring, however, is of limited use in that it offers little response to manipulation, and does not encourage later developing patterns of voluntary reaching and grasping, hand passing, and letting go, as will be explained below.

Other manipulative toys which incorporate a number of rings are the "Space Rings" TM marketed by Creative Playthings and the "Gyro" marketed by Agate Plastics Corporation. The "Gyro" has three rigid concentric rings with a single rigid axis that extends therethrough. The "Space Rings" TM has three rigid concentric rings. The largest ring has two opposed knobs on its inside surface which snap into openings in the outer surface of the middle ring, providing an axis of rotation of the largest ring with respect to the middle ring. The middle ring, in turn, has two opposed knobs on its inside surface which are located along a line which is perpendicular to the line described by the knobs of the outer ring. The knobs in the middle ring snap into openings provided on the outer surface of the smallest ring, providing an axis of rotation of the middle ring (and largest ring) with respect to the smallest ring. Thus, while the toy has an altering, rather than a rigid, axis, the axis of each ring is normal to the axis of its next innermost ring, and all movement is rotational about a common center. Both toys are limited in their movement, providing a limited response during play, and offer a limited number ofgrasping sites for continued interaction.

Another prior art toy consisting of a number of rings is disclosed in U.S. Design Pat. No. 140,681 to Stuart. The toy comprising three discontinuous or open concentric rings attached together with a string or cord. The openings in the rings are aligned, the string passes through the rings, along one side of the openings, toward their center; and back out again along the other side of the openings. This structure does not have the limiting axes of rotation seen in the "Space Rings" or "Gyro", but exhibits such an independence of movement of the rings to severely limit the toy's ability to provide an interesting and enticing response to manipulation.

During the earliest stages of a child's development, the toy of the present invention may be used in a manner similar to the Gesell ring to practice and develop reflex grasping as well as eye tracking. The toy may also be held by the primary handle or end object and twirled to present a moving, 3-dimensional viewing object. The ring structure offers a grasping object with no top or bottom or ends that the child's hand could easily slip off of without accomplishing a grasp of the object.

At some time between six weeks and three months a child's replex grasp gives way to a voluntary grasp, and between three to six months of age a child learns to bring to its mouth the objects it has grasped. This results in a predictable pattern wherein the child grasps an object with one hand, grasps it again with the other hand, and, if then in control of the object, brings it to his mouth. The toy of the present invention is designed to accommodate and encourage these early stages and patterns of grasping by providing numerous possible grasping sites.

Between six and nine months, the child learns to transfer objects from one hand to the other. The toy of the present invention encourages the child to begin and to practice this sequence of actions. Once initially grasped, the toy responds by moving to create different configurations and opportunities for grasping with the other hand. This movement is accompanied by a quivering, shaking action of the rings and central object which attracts the child's attention and may also cause a bell located in the central object or end object to ring. One of the objectives of the design of this toy was that it be most responsive to random movement and offer a seemly endly variety of shapes and potential grasping sites for this hand-to-hand practising. Coordination is developed by this practice and repetition, and the movement and variety of configurations assumed by the Red Rings provide many different practice sequences for the development of co-ordination.

A little later on in the child's development, between nine and twelve months, he learns gradually to let go of an object. The child first releases his grip unconsciously and slowly, often causing the toy to drop on himself, or possibly, in the case of a large ring, causing the ring to slide down his arm. At this stage in his development, the child would encounter difficulty disengaging his arm from the ring. The smallest ring and central object of the preferred embodiment prevent the ring from travelling down the child's arm, and also provide many opportunities for finger grasping and entanglement which discourage the unintentional releasing of the toy, thereby aiding in this stage of development.

Throughout the life of the toy, play opportunities can be expanded by the involvement of an adult. These expanded opportunities include a gentle "tug of war" (particularly desired by children from six to nine months) and a whole variety of imitative games, usually begun at about nine months, wherein a child will attempt to mimic various manipulative steps and sequences performed by an adult and will later, during independent play, attempt to recreate these movements with the toy.

SUMMARY OF THE INVENTION

The toy of the present invention is a learning and development toy for children from birth to about 18 months. The toy comprises a plurality of rings of varying diameter, including a largest ring, and a central object which are connected by a readily flexible, pliable connecting means. The rings and central object are of a size, and are spaced along the connecting means such that when the toy is held aloft and suspended by the point of connection of the largest ring and the connecting means, the toy assumes a configuration wherein the rings are spaced from each other and from the central object, and are concentric about the central object. The flexible connecting means may be extended beyond the rings to form a handle. A bell may be contained within the central object or the handle.

The shape and flexibility of the various segments of the toy create an extremely mobile toy that can readily assume or be twisted into a myriad of configurations, and which offers a vast number of potential grasping sites. The enticing shape and movements of the toy together with the number of possible grasping sites encourages and aids in the development of voluntary grasping. The number of potential grasping sites offered by each configuration of the toy aids in the accomplishment and practice of the sequence of right (or first) hand grasp followed by left (or second) hand grasp.

The lively movement of the toy in response to manipulation encourages all play patterns and specifically provides continued interest during hand-to-hand passing by the child. Continued interest and expertise in hand-to-hand passing is enhanced by the number of configurations the toy can assume and the number of possible grasping sites offered by each configuration. The shape, movement, and flexibility of the toy, provide a toy that is useful during the continuing development and practice of hand manipulation in an infant.

DETAILED DESCRIPTION OF THE INVENTION

Figure 1:
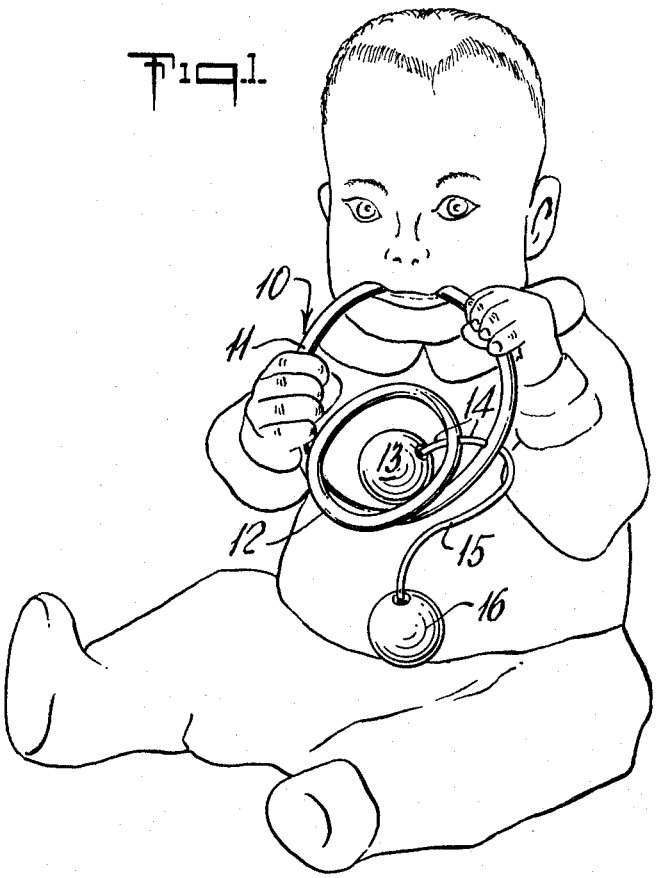
FIG. 1 is a view of a preferred embodiment of the invention, held by an infant.

FIG. 1 illustrates a preferred embodiment of the present invention. The toy shown generally at 10, has a largest ring 11 and a next largest ring 12 of firm, flexible, chewable, non-toxic material suitable for teething. The rings are connected to each, and to a central object 13, by a flexible connecting means 14. The connecting means 14 may be extended beyond the largest ring 11, to form a primary handle 15, which may have, connected thereto, an end object 16.

The largest ring 11 is approximately five inches in inside diameter, and is large enough to fill, but not exceed, an infant's field of perception for a self-held toy, and small enough that it cannot fit over the infant's head. The rings may be pulled or stretched, but return to their original shape when released. The rings are of a small enough cross-sectional diameter to be easily grasped by a very young child. The central object 15 and the end object 16 are small enough to be mouthed, but not swallowed.

The flexible connecting means 14, is formed integrally with the rings 11 and 12 and is much more flexible than the rings, allowing the rings to move and be moved independently of each other. The mobility of the rings and the central object allow the toy to assume a myriad of configurations which provide innumerable grasping sites. The flexibility of the connecting means allows the toy to respond to movement thereof by changing in shape or configuration. These two characteristics of the toy enhance the availability of interaction, and the response to interaction with the toy. When the toy moves and assumes a new configuration it invites the infant to respond to it, and makes available to the infant a variety of sites for grasping or hitting.

Figure 2:
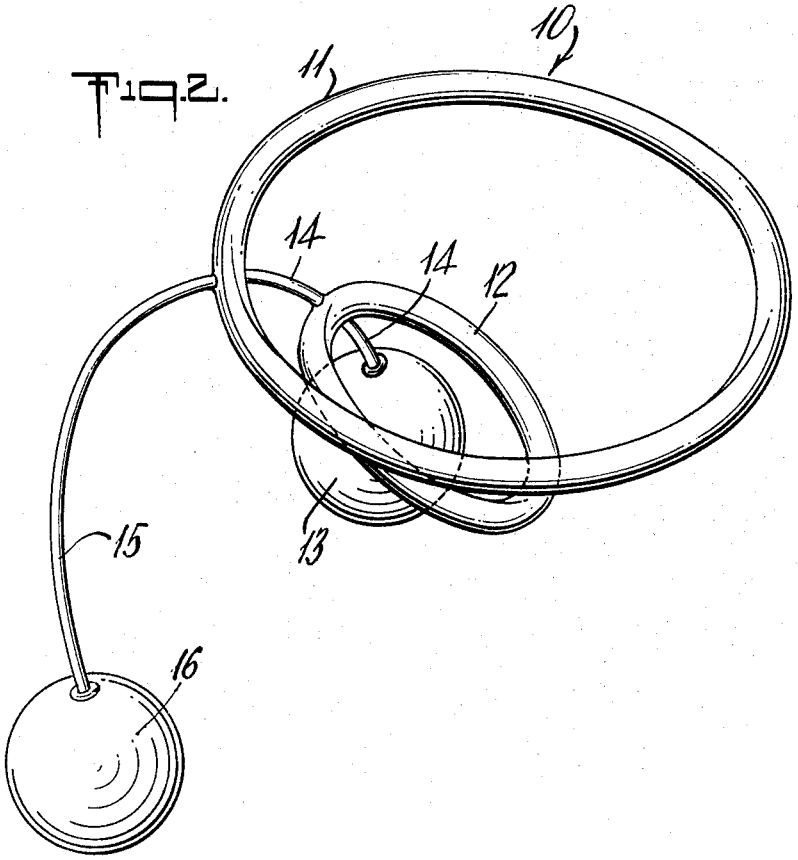
FIG. 2 is a perspective view of the preferred embodiment of FIG. 1, illustrating the configuration assumed when the largest ring is stabilized in approximately the horizontal position and the rest of the toy is allowed to flex or fall freely.

FIG. 2 illustrates the flexibility of the preferred embodiment of FIG. 1 in the configuration it assumes when the largest ring 11 is fixed in a relatively horizontal position. Many different materials were tested for forming the rings and connecting means, with the objective being to form the toy such that: the rings were flexible but resilient and suitable for teething; the connecting means were much more readily flexible than the rings providing the mobility of the rings and central object but resilient enough to cause at least a quivering, jiggling motion of the rings and central object upon only slight movement of the rings. Though many flexible materials may be used to form the rings and connecting means, the preferred embodiment is formed of Solprene #486 TM, a thermoplastic rubber comprising a butadiene, styrene copolymer, with the connecting means having a much smaller cross-sectional diameter than the rings.

Figure 3:
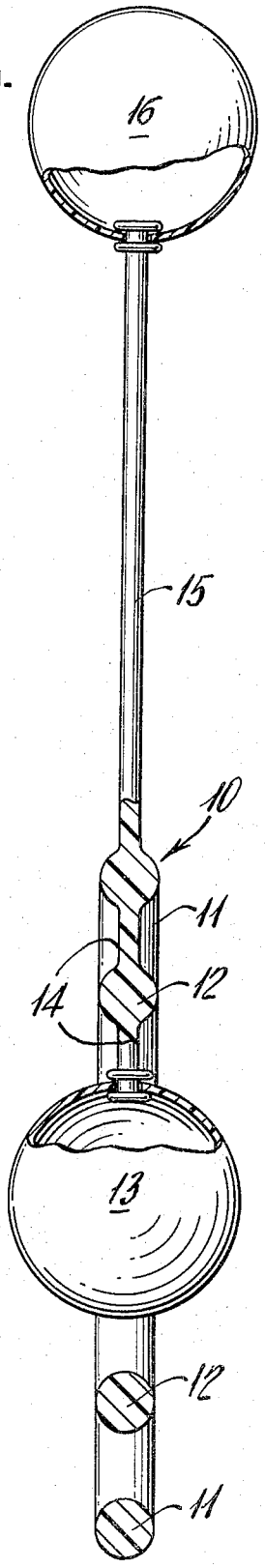
FIG. 3 is a side view of the preferred embodiment of FIG. 1 placed in a planar configuration with the rings partially cut-away to show the cross-section of the rings and of the joining of the rings and the connecting means; and with the central object and end ball partially cut-away to show the joining of the central object and the end ball to the connecting means.

As illustrated in FIG. 3, in the preferred embodiment of the toy of FIG. 1, the rings and connecting means are integrally formed of the same material. Also, the rings are of a size, and are positioned along the connecting means at such intervals that the preferred embodiment of the toy may be placed in the configuration illustrated in FIG. 3, and will assume such a configuration if suspended by the end object. In its broadest aspect the toy of the present invention does not have a primary handle or end object, however the rings, connecting means and central object will assume the configuration in which they are shown in FIG. 3 if the toy is suspended by the point of connection of the largest ring and the connecting means. As shown in FIG. 3, the rings and central object are spaced from each other and the rings are concentric about the central object. As also shown in FIG. 3, the hollow central object and end object are each attached to the connecting means by double flexible flanges extending outwardly from the connecting means and separated from each other by a distance slightly larger than the thickness of the hollow central object and end object. Flange 16 is of a size such that, once disposed within the central object or end object, it is exceedingly difficult to pull apart the connecting means and central object or end object. Flange 17 prevents the connecting means from travelling further within the central object or end object.

What is claimed is:

1. An infant development toy comprising: a plurality of rings of varying diameter, including a largest ring, a next largest ring, a central object, and flexible connecting means connecting said central object and said plurality of rings in such a manner, that when the toy is freely suspended from the point of connection of the largest ring and the connecting means, the connecting means is disposed vertically as the toy assumes a configuration wherein the rings are concentric about the central object, said flexible connecting means being the sole means connecting said rings, and said connecting means being sufficiently flexible that the next largest ring is readily movable out of the plane defined by the largest ring.

2. Infant development toy as in claim 1 wherein the flexible connecting means extends outwardly of the rings, forming a primary handle.

3. Infant development toy as in claim 2 wherein the rings are made of a firm, flexible material suitable for teething.

4. Infant development toy of claim 3 wherein said rings and said connecting means are integrally formed.

5. Infant development toy as in claim 3 wherein the central object comprises a hollow sphere containing a bell.

* * * * *